US009325055B2

(12) United States Patent
Kato et al.

(10) Patent No.: US 9,325,055 B2
(45) Date of Patent: Apr. 26, 2016

(54) ANTENNA APPARATUS HAVING VIBRATION ISOLATION

(75) Inventors: Yasuaki Kato, Tokyo (JP); Noboru Kawaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 123 days.

(21) Appl. No.: 14/240,160

(22) PCT Filed: Jul. 26, 2012

(86) PCT No.: PCT/JP2012/068989

§ 371 (c)(1),
(2), (4) Date: Feb. 21, 2014

(87) PCT Pub. No.: WO2013/031443

PCT Pub. Date: Mar. 7, 2013

(65) Prior Publication Data

US 2014/0191922 A1 Jul. 10, 2014

(30) Foreign Application Priority Data

Aug. 31, 2011 (JP) ..... 2011-189314

(51) Int. Cl.
*H01Q 1/42* (2006.01)
*H01Q 1/18* (2006.01)
(Continued)

(52) U.S. Cl.
CPC . *H01Q 1/18* (2013.01); *H01Q 1/12* (2013.01); *H01Q 1/42* (2013.01); *H01Q 3/20* (2013.01); *H01Q 19/134* (2013.01)

(58) Field of Classification Search
CPC ..... H01Q 1/005; H01Q 1/12; H01Q 1/18; H01Q 1/34; H01Q 1/42; H01Q 3/20; H01Q 1/20; H01Q 1/13
USPC ..... 343/872, 761, 709; 248/591
See application file for complete search history.

(56) References Cited

U.S. PATENT DOCUMENTS 1,569,325 A 1/1926 Leib
4,118,707 A * 10/1978 Yoshida ..... H01Q 3/08 33/321

(Continued)

FOREIGN PATENT DOCUMENTS

JP 52 132658 11/1977
JP 57-4601 A 1/1982

(Continued)

OTHER PUBLICATIONS

Office Action issued Sep. 24, 2014 in Japanese Patent Application No. 2013-531175 (with English language translation).

(Continued)

*Primary Examiner* — Lam T Mai
(74) *Attorney, Agent, or Firm* — Oblon, McClelland, Maier & Neustadt, L.L.P.

(57) ABSTRACT

An antenna apparatus is provided which has a centroid close to a vibration isolation structure and which is hard to vibrate like a pendulum motion when vibration is applied. The antenna apparatus includes a first base plate, an antenna unit disposed at a side of the first base plate and supported by the first base plate, and a counter weight unit disposed at another side of the first base plate opposite to the antenna unit and supported by the first base plate. The antenna apparatus further includes a vibration isolation structure having one end fixed to the first base plate to suppress a vibration of the first base plate, and a second base plate to which other end of the vibration isolation structure is fixed and which is fixed to a moving object or a structural object.

13 Claims, 16 Drawing Sheets

(51) Int. Cl.

| | |
|---|---|
| ***H01Q 1/12*** | (2006.01) |
| ***H01Q 3/20*** | (2006.01) |
| ***H01Q 19/13*** | (2006.01) |

(56) References Cited

U.S. PATENT DOCUMENTS

| | | | | |
|---|---|---|---|---|
| 4,197,548 | A * | 4/1980 | Smith | H01Q 1/18 343/757 |
| 4,609,083 | A | 9/1986 | Stuhler | |
| 5,410,325 | A | 4/1995 | Friedrich et al. | |
| 5,588,369 | A | 12/1996 | Rizkalla et al. | |
| 6,559,805 | B2 | 5/2003 | Yamauchi et al. | |
| 7,382,327 | B2 * | 6/2008 | Nelson | B63B 17/0081 343/709 |
| 2003/0016177 | A1 | 1/2003 | Deguchi et al. | |
| 2007/0097004 | A1 * | 5/2007 | Sohfuku | G02B 23/16 343/757 |

FOREIGN PATENT DOCUMENTS

| | | |
|---|---|---|
| JP | 60 007202 | 1/1985 |
| JP | 04 359178 | 12/1992 |
| JP | 05 343913 | 12/1993 |
| JP | 06 053719 | 2/1994 |
| JP | 06 090106 | 3/1994 |
| JP | 08 316061 | 11/1996 |
| JP | 10 107530 | 4/1998 |
| JP | 2001 042024 | 2/2001 |
| JP | 2003 042227 | 2/2003 |
| JP | 2008 228045 | 9/2008 |
| JP | 2011 064244 | 3/2011 |
| JP | 2011 087044 | 4/2011 |
| SE | 7711907 A | 4/1979 |
| TW | 538559 B | 6/2003 |

OTHER PUBLICATIONS

Office Action issued Dec. 24, 2014 in Korean Patent Application No. 10-2014-7003493 (with English language translation).

Office Action issued Dec. 3, 2014 in Chinese Patent Application No. 201280042399.9 (with English language translation).

Extended European Search Report issued Mar. 19, 2015 in Patent Application No. 12827108.7.

Office Action issued on Jun. 25, 2015 in Korean Patent Application No. 10-2014-7003493 with English translation.

International Search Report Issued Oct. 23, 2012 in PCT/JP12/068989 Filed Jul. 26, 2012.

Office Action mailed Nov. 5, 2015 in Taiwanese Patent Application No. 101128549 (with English Translation).

Combined Office Action and Search Report issued Jun. 3, 2015 in Taiwanese Patent Application No. 101128549 (with English language translation and English Translation of Category of Cited Documents).

* cited by examiner

ANTENNA APPARATUS HAVING VIBRATION ISOLATION

TECHNICAL FIELD

The present invention relates to an antenna apparatus. More specifically, the present invention relates to an antenna apparatus (a tracking antenna) which tracks radio waves from a communication counterparty, such as a satellite, an earth station, or a mobile station, to control the direction of an antenna.

BACKGROUND ART

An example and conventional antenna apparatus which tracks radio waves from a communication counterparty to change the direction of an antenna is provided with a counter weight at the antenna-apparatus side of a base plate and a vibration isolation structure between the counter weight and the base plate (see, for example, Patent Literature 1). Moreover, there is a communication antenna apparatus having an AZ (azimuth)/EL (elevation) two-axis drive antenna or an AZ/cross-EL/EL three-axis drive antenna which ensures fixing of an antenna unit at the time of detaching a unit to improve the serviceability (see, for example, Patent Literature 2).

Regarding the placement of the counter weight, like the antenna apparatus disclosed in Patent Literature 1, it is apparent that both the antenna and the counter weight are provided at the same side of the base plate (see, for example, Patent Literatures 3 and 4). As disclosed in Patent Literature 5, an antenna apparatus, in which a counter weight is embedded to the lower end of its antenna, has a pivot located at the middle of the antenna and the antenna is provided to be able to rotate around the pivot. As a vibration isolation structure of an antenna apparatus, a helical isolator disclosed in, for example, Patent Literatures 6 to 8 is often used.

CITATION LIST

Patent Literatures

Patent Literature 1: Unexamined Japanese Patent Application Kokai Publication No. 2008-228045

Patent Literature 2: Unexamined Japanese Patent Application Kokai Publication No. 2011-87044

Patent Literature 3: Unexamined Japanese Patent Application Kokai Publication No. H5-343913

Patent Literature 4: Unexamined Japanese Patent Application Kokai Publication No. H10-107530

Patent Literature 5: Unexamined Japanese Patent Application Kokai Publication No. H6-53719

Patent Literature 6: Unexamined Japanese Patent Application Kokai Publication No. H8-316061

Patent Literature 7: Unexamined Japanese Patent Application Kokai Publication No. 2003-42227

Patent Literature 8: Unexamined Japanese Patent Application Kokai Publication No. 2011-64244

SUMMARY OF INVENTION

Technical Problem

According to the antenna apparatuses disclosed in Patent Literatures 1 to 4, however, due to the structural constraint, it is difficult to position the centroid further closer to the base plate. According to the antenna apparatus disclosed in Patent Literature 5, the antenna and the counter weight are directly coupled with each other, and even if this structure is applied to a tracking antenna, the centroid cannot be made closer to the base plate. Moreover, according to the antenna apparatuses disclosed in Patent Literatures 1 to 4, since it is difficult to shift the centroid to a further downward position, when vibration is applied to the antenna apparatuses, such antenna apparatuses are likely to vibrate like a pendulum motion.

The present invention has been made in order to solve the above-explained technical issue, and it is an objective of the present invention to provide an antenna apparatus which has a centroid close to a vibration isolation structure and which is hard to vibrate like a pendulum motion when vibration is applied to the antenna apparatus.

Solution to Problem

To achieve the above objective of the invention, an aspect of the present invention provides an antenna apparatus that includes: a first base plate; an antenna unit which is disposed at a side of the first base plate and which is supported by the first base plate; and a counter weight unit which is disposed at another side of the first base plate opposite to the antenna unit, and which is supported by the first base plate. The antenna apparatus further includes: a vibration isolation structure that has one end fixed to the first base plate to suppress a vibration of the first base plate; and a second base plate to which other end of the vibration isolation structure is fixed, and which is fixed to a moving object or a structural object.

Advantageous Effects of Invention

According to the present invention, the counter weight unit is supported at a side of the first base plate opposite to another side thereof where the antenna unit is disposed. Hence, the centroid is made closer to the vibration isolation structure and the vibration isolation structure that joins the first base plate and the second base plate together prevents the antenna unit from vibrating like a pendulum motion.

DESCRIPTION OF EMBODIMENT

Embodiment

Figure 1:
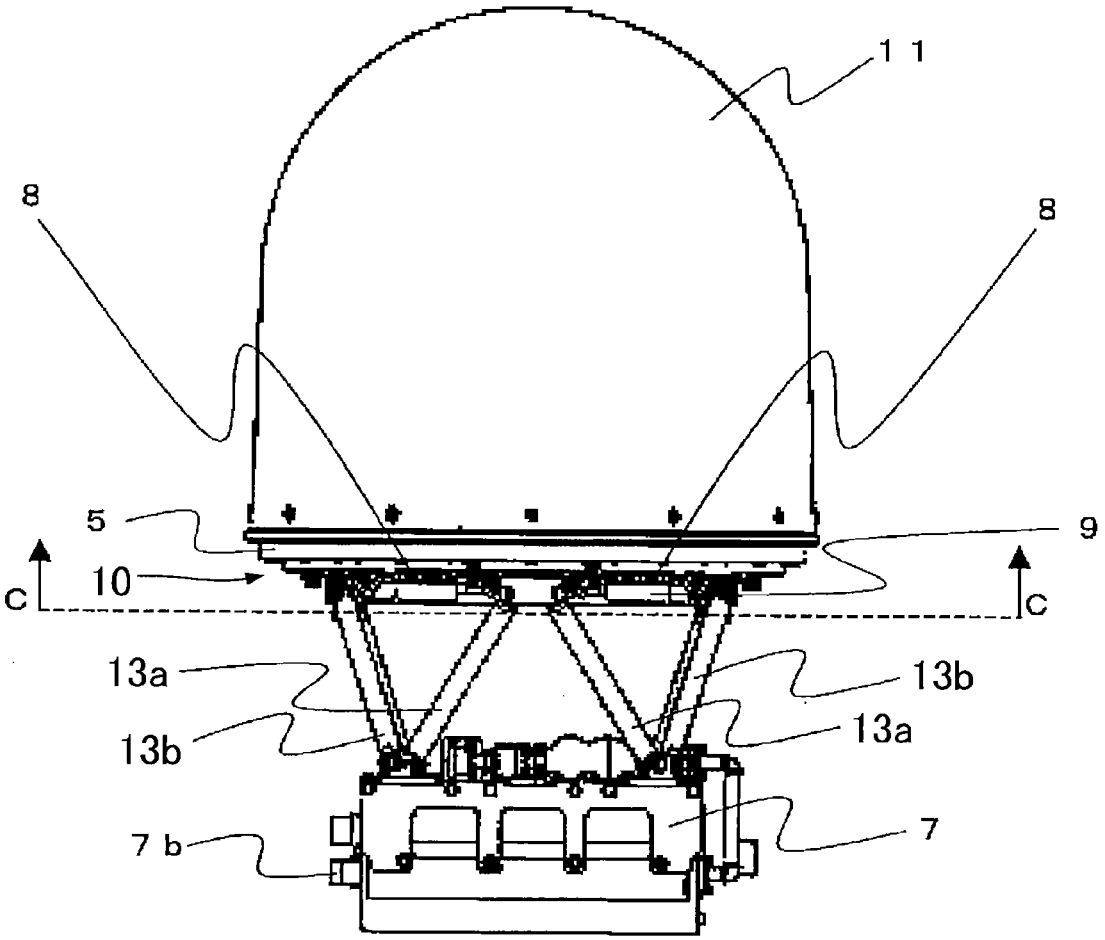
FIG. 1 is a structural diagram showing an antenna apparatus provided with a radome according to an embodiment of the present invention.
Figure 2:
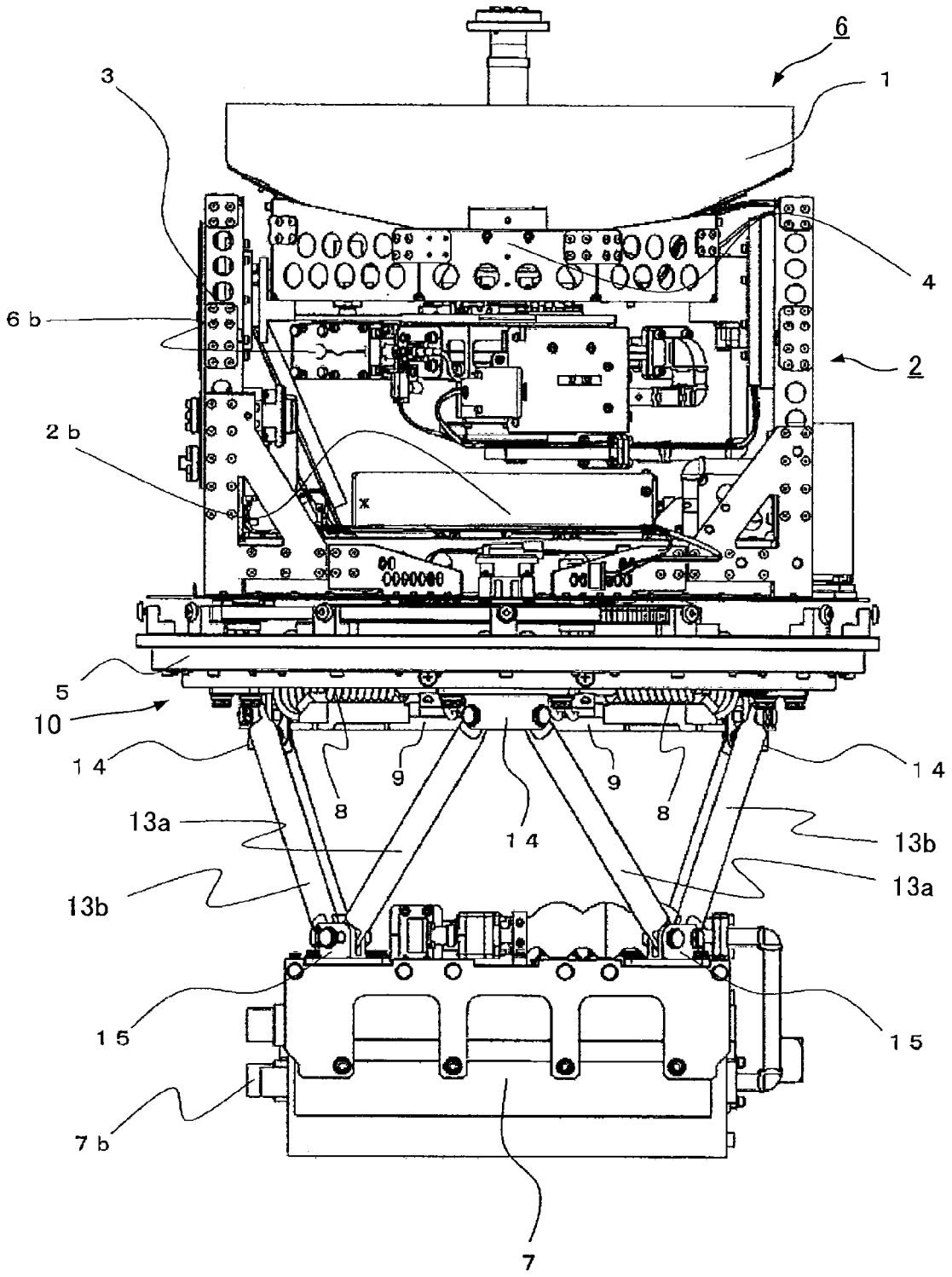
FIG. 2 is a structural diagram showing the antenna apparatus according to the embodiment when the radome is detached.

An embodiment to carry out the present invention will be explained in detail with reference to the accompanying drawings. The same or corresponding component will be denoted by the same reference numeral throughout the figures. FIG. 1 is a structural diagram showing an antenna apparatus provided with a radome according to an embodiment of the present invention. FIG. 2 is a structural diagram showing the antenna apparatus according to the embodiment when the radome is detached.

An antenna apparatus includes an antenna unit 6, a base 10, and a counter weight unit 7. The antenna apparatus is used with the base 10 being fixed to a moving object or a structural object. Example moving objects are a vehicle like an automobile or a train, a ship, and an aircraft, such as an airplane, a helicopter, an airship, or a balloon. Example structural objects are a building of a satellite communication earth station, a cubicle containing thereinside a communication device, and a casing of the communication device. The moving object or the structural object to which the base 10 is fixed is referred to as an antenna apparatus mounting object.

The counter weight unit 7 is fixed to and supported by the base 10 through beams (beam: joist, column, cross member) 13*a* and 13*b*, etc. The antenna unit 6 is disposed at a side of the base 10, and is fixed to and supported by the base 10. The antenna unit 6 is covered by a radome 11 attached to the base 10. The base 10 includes a first base plate 5, a vibration isolation structure 8, and a second base plate 9. The first base plate 5 and the second base plate 9 are joined together via the vibration isolation structure 8 therebetween.

The antenna unit 6 includes a main mirror reflector 1 and an antenna driving unit 2. The antenna driving unit 2 includes a drive control unit 2*b*, an AZ/EL axis driving unit 3 and a POL axis driving unit 4. The antenna unit 6 also includes a low-noise amplifier (LNA) 6*b*.

The main mirror reflector 1 (reflecting mirror, parabola) reflects communication radio waves from a communication counterparty, such as a satellite, an earth station, or a mobile station, and concentrates the reflected radio waves to a primary radiator (at the time of reception). At this time, a sub mirror reflector may be additionally used. Moreover, at the time of transmission, a reverse operation, i.e., communication radio waves emitted from the primary radiator are reflected by the main mirror reflector 1, and are emitted toward the satellite, the earth station, or the mobile station, etc. The antenna driving unit 2 drives the main mirror reflector 1, and changes the direction of the main mirror reflector 1 relative to the base 10. The drive control unit 2*b* controls the antenna driving unit 2.

The AZ/EL axis driving unit 3 shown in FIG. 2 is a component of the antenna driving unit 2 which drives the main mirror reflector 1 in the azimuth direction and the elevation direction. The AZ/EL axis driving unit 3 may further drive the main mirror reflector in the cross elevation direction. In this case, the AZ/EL axis driving unit 3 performs three-axis driving. The POL axis driving unit 4 is also a component of the antenna driving unit 2, and changes the polarization angle of the main mirror reflector 1. The POL axis driving unit 4 may be omitted when the communication radio waves are circular polarized waves. The antenna unit 6 including the main mirror reflector 1 and the antenna driving unit 2 is supported by the first base plate 5. The antenna unit 6 has a function of operating as a typical tracking antenna.

The low-noise amplifier (LNA) 6*b* suppresses an addition of noises of the communication radio waves received by the antenna unit 6 and amplifies the communication radio waves. The antenna unit 6 fulfills a major part of the tracking function of the antenna apparatus (the tracking antenna) which tracks radio waves from the communication counterparty, and which controls the direction of the main mirror reflector 1.

The radome 11 has an opening fixed to the base 10 (the first base plate 5) by fastening means, such as a screw or fit-in, and covers the antenna unit 6. In other words, the first base plate 5 includes the radome 11 covering the opposite side of the counter weight unit 7. The radome 11 permits radio waves for a communication by the antenna unit 6 to pass through.

The counter weight unit 7 is disposed at a side of the first base plate 5 opposite to the antenna unit 6, and is supported by the first base plate 5. The counter weight unit 7 fixed to the first base plate 5 serves to shift the centroid of the antenna apparatus closer to the first base plate 5. The vibration isolation structure 8 has a vibration isolation structural configuration having an end fixed to the first base plate 5. The vibration isolation structure 8 includes functional components, such as a spring and a damper. To the second base plate 9 other end of the vibration isolation structure 8 are fixed. The second base plate 9 is disposed between the first base plate 5 and the counter weight unit 7 and near the first base plate 5. The second base plate 9 is fixed to the moving object or the structural object, and thus the antenna apparatus of this embodiment is fixed. According to this embodiment, an explanation will be given of an example case in which the vibration isolation structure 8 is a helical isolator disposed between the first base plate 5 and the second base plate 9.

Figure 7A:
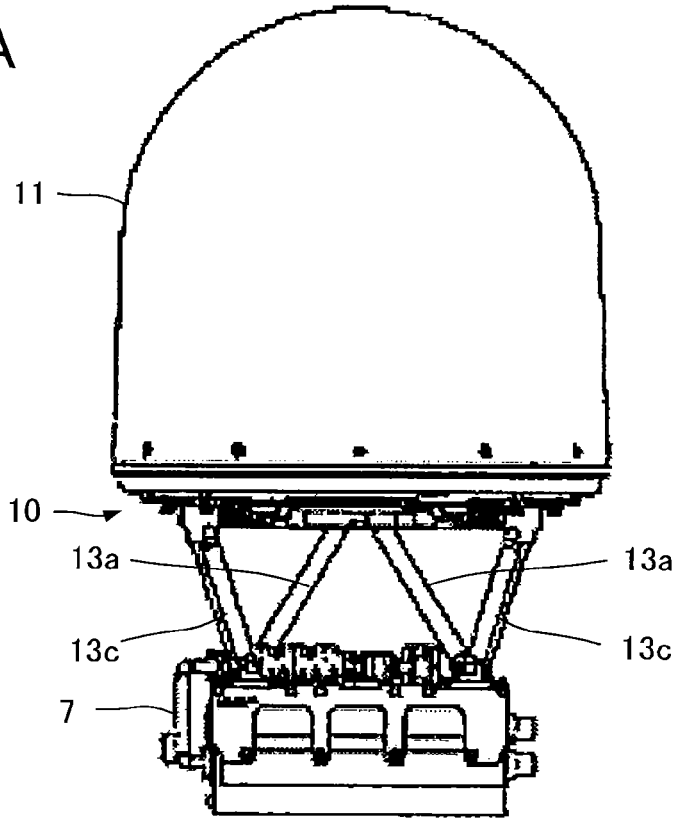
FIG. 7A is a back view showing the antenna apparatus provided with a radome according to the embodiment.
Figure 7B:
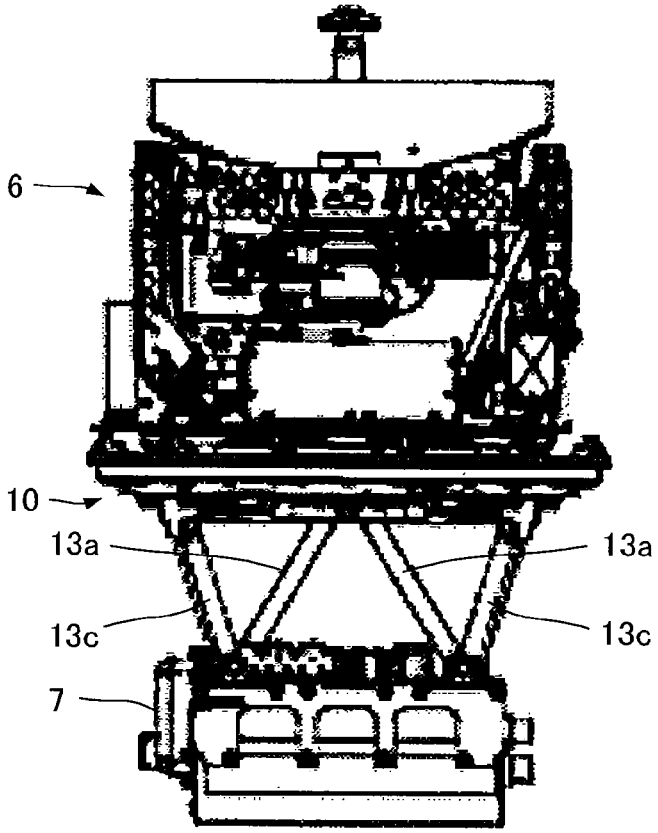
FIG. 7B is a back view showing the antenna apparatus according to the embodiment when the radome is detached.
Figure 8A:
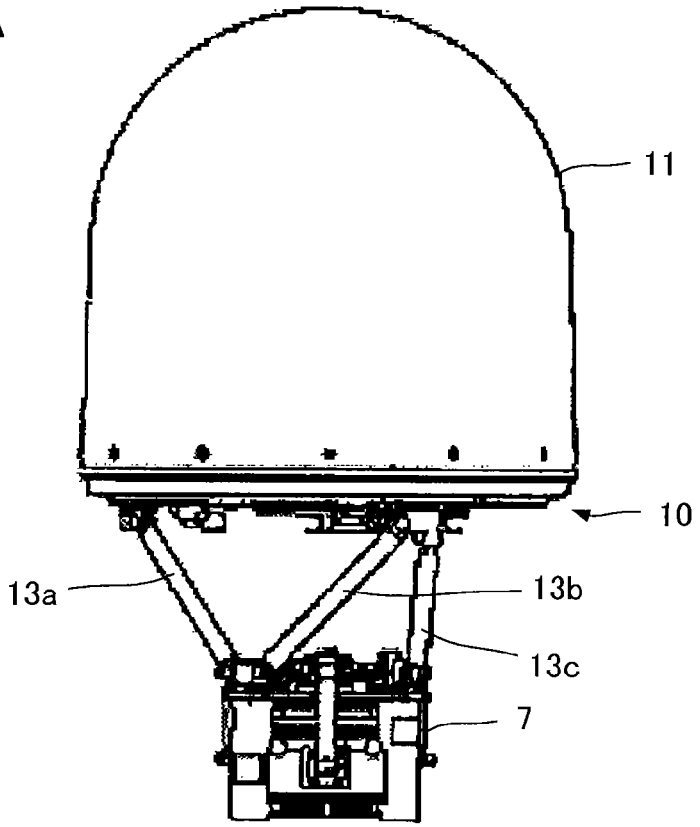
FIG. 8A is a right side view showing the antenna apparatus provided with a radome according to the embodiment.
Figure 8B:
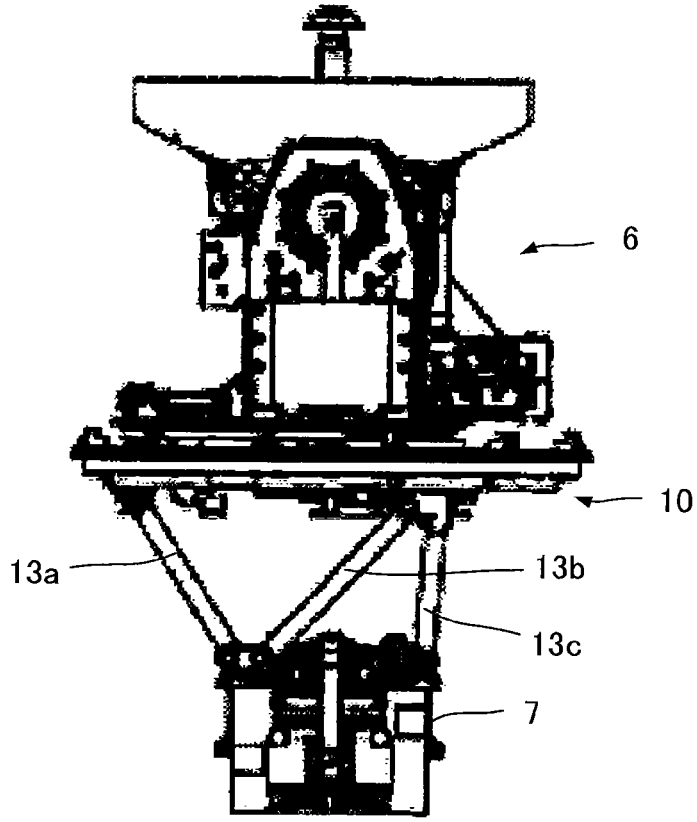
FIG. 8B is a right side view showing the antenna apparatus according to the embodiment when the radome is detached.
Figure 9A:
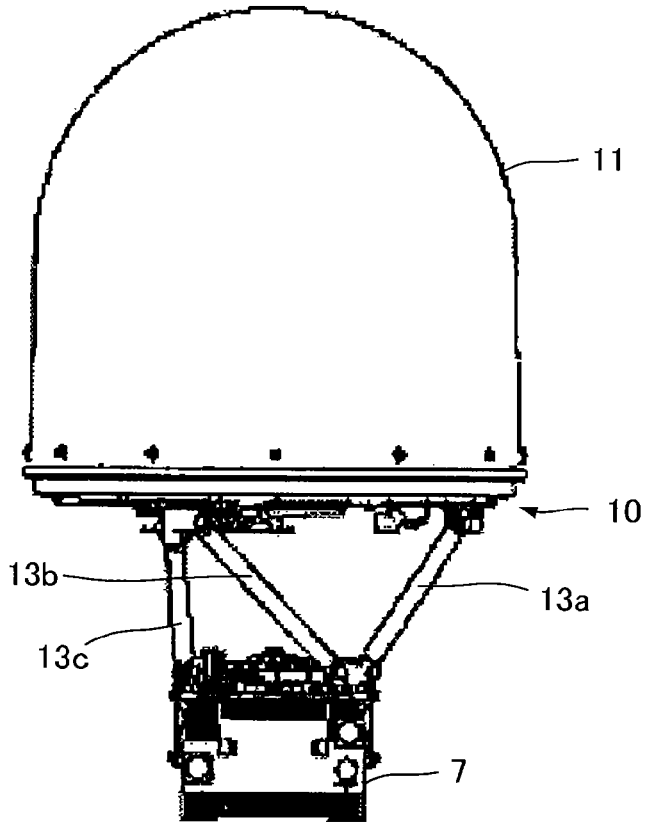
FIG. 9A is a left side view showing the antenna apparatus provided with a radome according to the embodiment.
Figure 9B:
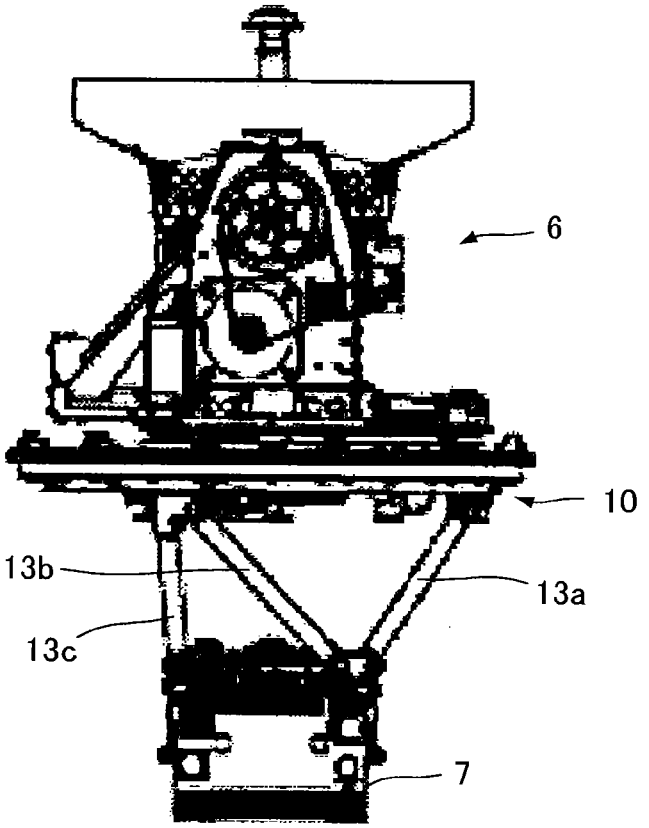
FIG. 9B is a left side view showing the antenna apparatus according to the embodiment when the radome is detached.
Figure 10A:
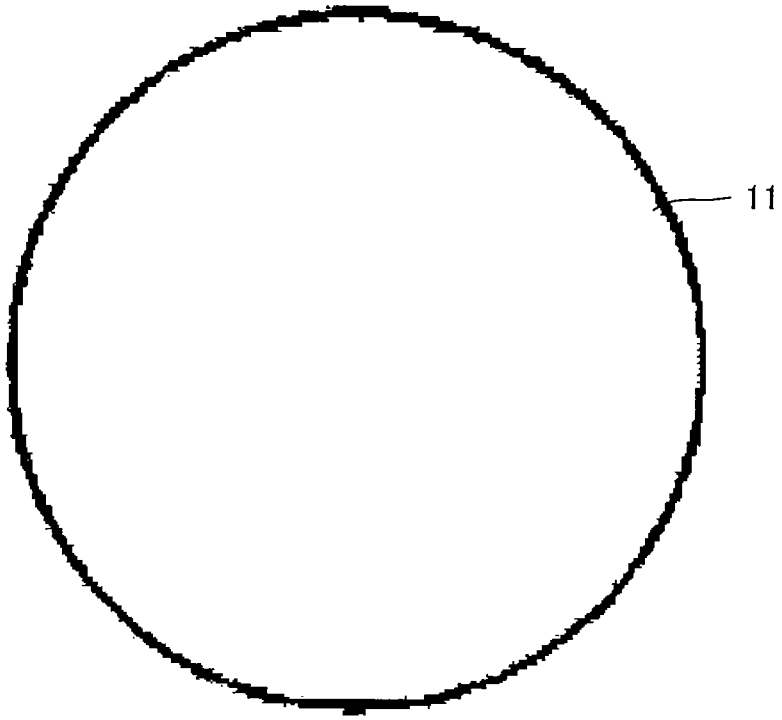
FIG. 10A is a top view showing the antenna apparatus provided with a radome according to the embodiment.
Figure 10B:
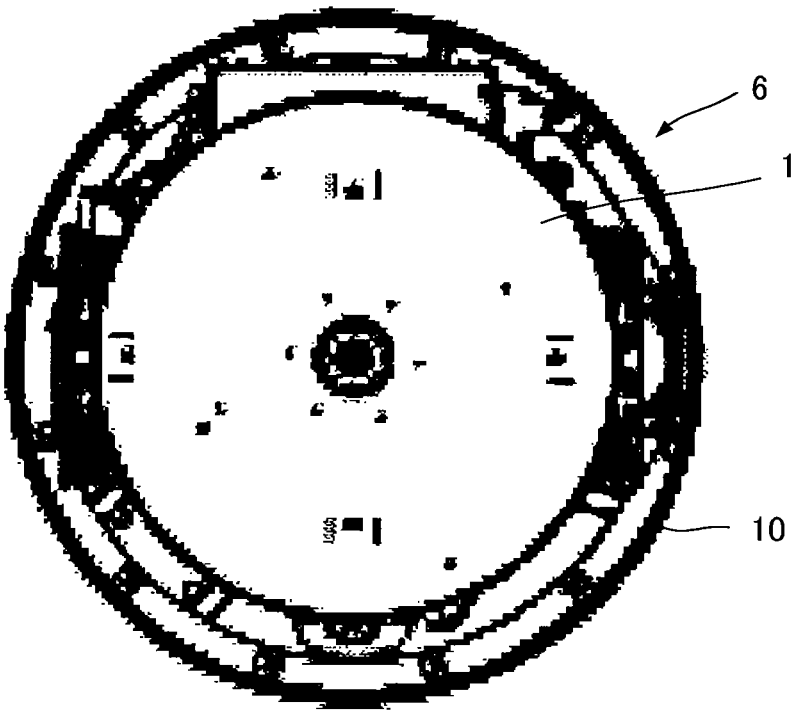
FIG. 10B is a top view showing the antenna apparatus according to the embodiment when the radome is detached.

The counter weight unit 7 is fixed to the first base plate 5 through beams 13*a*, 13*b*, and 13*c* (see FIG. 7) at a side of the first base plate 5 opposite to the antenna unit 6, and is supported by the first base plate 5. The beam 13*c* is hidden behind the beam 13*b* in FIGS. 1 and 2. Respective one ends of the beams 13*a*, 13*b*, and 13*c* are fastened (fixed) to, by fastening means (fixing means) like a bolt, first beam fixing portions 14 formed on the first base plate 5. Respective other ends of the beams 13*a*, 13*b*, and 13*c* are fastened (fixed) to, by fastening means (fixing means) like a bolt, second beam fixing portions 15 formed on the counter weight unit 7. The beams 13*a*, 13*b*, and 13*c* may be collectively referred to as the beam 13 when any of those beams is pointed out.

At least one first beam fixing portion 14 to which respective one ends of the two beams 13 are fixed at a distance that can be regarded as a pin joint. Moreover, at least one second beam fixing portion 15 to which respective other ends of the two beams 13 are fixed at a distance that can be regarded as a pin joint. The distance that can be regarded as a pin joint means a distance that has a bending strain between joining points ignorable with respect to the bending strain of the beam 13. Moreover, the two beams 13 having respective one ends fixed to the same first beam fixing portion 14 have respective other ends fixed to the different second beam fixing portions 15. That is, at least some of the beams configure a truss structure.

The first beam fixing portion 14 and the second beam fixing portion 15 may be integral pieces with the first base plate 5 and the counter weight unit 7, respectively, or may be separate pieces. According to this embodiment, the first beam fixing portion 14 and the second beam fixing portion 15 are separate pieces from the first base plate 5 and the counter weight unit 7, respectively, and are fastened thereto by screws, which is shown in the figures.

The first beam fixing portion 14 and the second beam fixing portion 15 may be omitted as a structure of the beam 13 in some figures. Both of or either one of the first beam fixing portion 14 and the second beam fixing portion 15 may be an integral portion with the beam 13.

As shown in FIGS. 1 and 2, the antenna apparatus of this embodiment includes the antenna unit 6 disposed at one side of the base 10, and the counter weight unit 7 disposed at another side of the base 10 and supported by the base 10. The antenna apparatus includes a transmitting/receiving process unit contained in the counter weight unit 7. The transmitting/receiving unit receives signals (communication radio waves) received by the main mirror reflector 1 and through a filter and the LNA 6*b*, and transmits signals through the antenna unit 6. The counter weight unit 7 has, as an outer shell, a casing (a case) containing thereinside the transmitting/receiving unit.

The antenna apparatus of this embodiment utilizes the mass of the transmitting/receiving process unit as the counter weight of the antenna unit 6. When the mass as the counter weight is insufficient by only the transmitting/receiving process unit, in addition to the transmitting/receiving process unit, a component serving as a "weight" can be added. In this case, the counter weight unit 7 is configured by the transmitting/receiving process unit and the "weight".

According to the antenna apparatus, since the transmitting/receiving process unit (the counter weight unit 7) is present outside the antenna unit 6 (the radome 11), and is supported by the base 10 through the beams 13 at a side opposite to the antenna unit 6, there is an advantageous effect from the standpoint of cooling. Moreover, the transmitting/receiving process unit 7 is accessible without detaching the radome 11, and thus the maintenance is easy.

Since the transmitting/receiving process unit (the counter weight unit 7) is supported by the base 10 (the first base plate 5) through the plurality of beams 13, at least some of cables (signal lines and control lines, etc.,) interconnecting the transmitting/receiving process unit and the antenna unit 6 can be fixed to any of the plurality of beams 13.

When the transmitting/receiving process unit has a mass beyond the necessity as the counter weight unit 7, some of the circuits and boards for realizing the functions of the transmitting/receiving process unit may be disposed in an antenna apparatus mounting object or the antenna unit 6 for weight balancing. The above-explained "weight" can be used for fine adjustment of the weight balancing. Moreover, the mass of the beam 13 (including the first beam fixing portion 14 and the second beam fixing portion 15) and the number thereof can be utilized for the fine adjustment of the weight balancing. When the counter weight unit 7 fulfills at least some of the functions of the transmitting/receiving process unit, it can be regarded that the counter weight unit 7 includes the transmitting/receiving process unit.

As shown in FIGS. 1 and 2, the base 10 includes the first base plate 5 that supports the antenna unit 6 and the counter weight unit 7 (the transmitting/receiving process unit 7), and the second base plate 9 which is joined with the first base plate 5 and which is fixed to the antenna apparatus mounting object. The second base plate may be referred to as a base plate, while the first base plate 5 may be referred to as an antenna supporting component, a counter weight supporting component, or an antenna-counter-weight supporting component.

According to the antenna apparatus of this embodiment, since the counter weight unit 7 is provided at a side of the base 10 opposite to the antenna unit 6, in comparison with a case in which the counter weight is provided at the antenna-unit side of the base, the centroid can be made largely closer to the base. As a result, an antenna apparatus having the centroid close to the position where the antenna apparatus is fixed can be obtained.

Figure 3A:
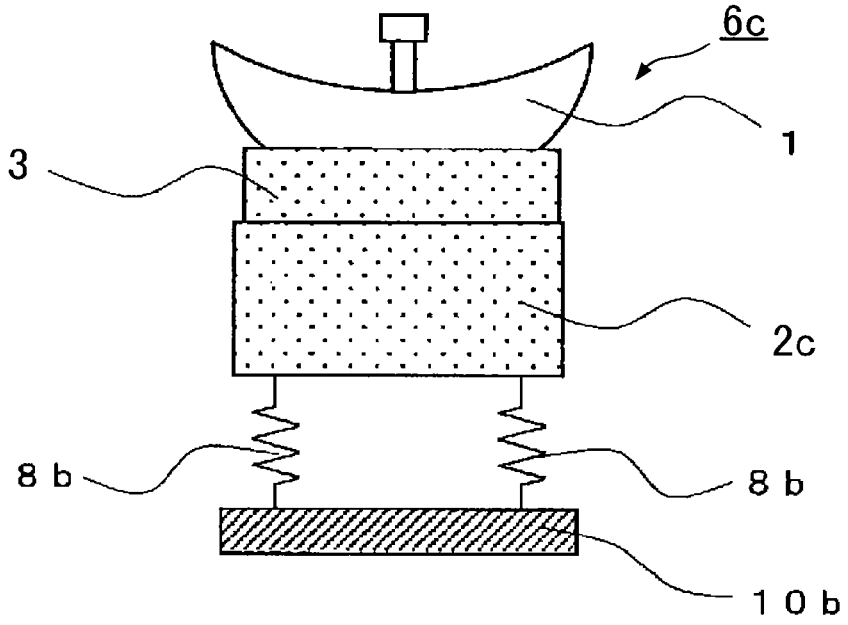
FIG. 3A is an exemplary diagram showing a case in which an antenna apparatus is placed at a side of a base.

FIG. 3A is an exemplary diagram showing a case in which the antenna apparatus is disposed at a side of the base. The antenna apparatus shown in FIG. 3A has the counter weight or a component corresponding thereto in an antenna unit 6*c* unlike the antenna apparatus of this embodiment. The antenna apparatus shown in FIG. 3A has a counter weight (a weight) at the antenna-unit-6*c* side of a base 10*b*. When the counter weight is disposed at the antenna-unit-6*c* side of the base 10*b*, an advantage that the weight can be located closer to the base 10*b* to some extent and an advantage of vibration isolation are obtained, but in comparison with the antenna apparatus shown in FIGS. 1 and 2, what the antenna apparatus shown in FIG. 3A can obtain are merely a higher centroid and a weaker vibration isolation function.

Figure 3B:
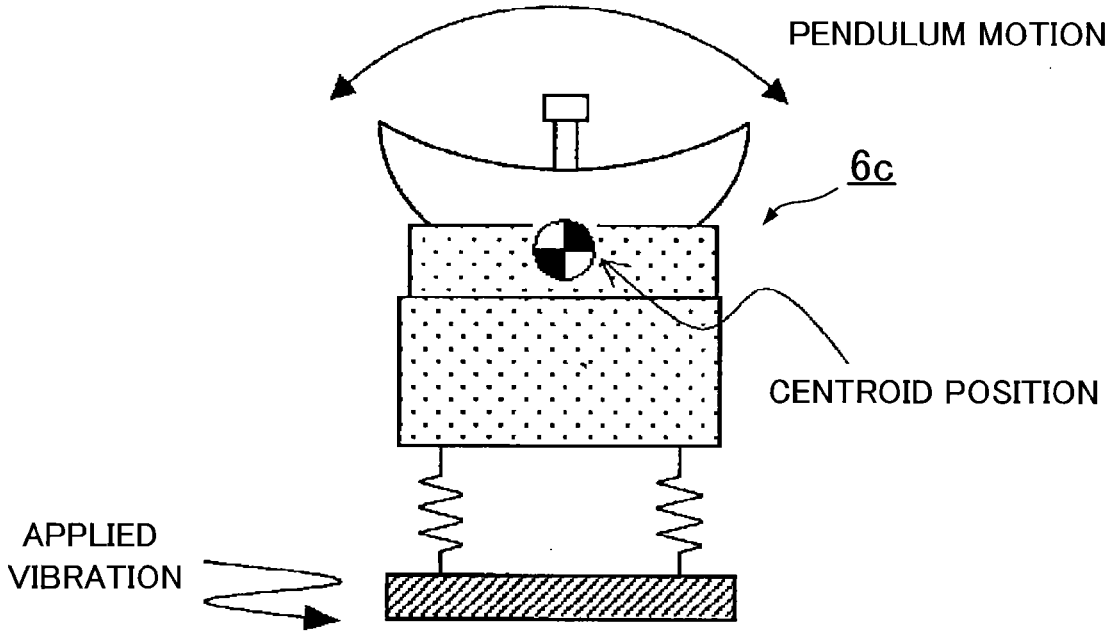
FIG. 3B is an explanatory diagram exemplarily showing a case in which vibration is applied to the base of the antenna apparatus shown in FIG. 3A.

FIG. 3B is an explanatory diagram exemplarily showing a case in which vibration is applied to the base of the antenna apparatus shown in FIG. 3A. Because of the structure explained with reference to FIG. 3A, the placement of the counter weight is restricted, and the centroid of the antenna apparatus is inevitably not close to a vibration isolation structure 8*b*. Hence, when vibration is applied to the antenna apparatus in the horizontal direction, the whole antenna apparatus (the antenna unit 6*c*) largely tilts, and thus the main mirror reflector 1 starts vibrating around the base 10*b* like a pendulum motion (indicated by a circular arc arrow in FIG.

3B). Such tilting of the main mirror reflector 1 increases the directivity error to a satellite, an earth station, or a mobile station, which may disturb the operation and the communication of the antenna apparatus.

Figure 4A:
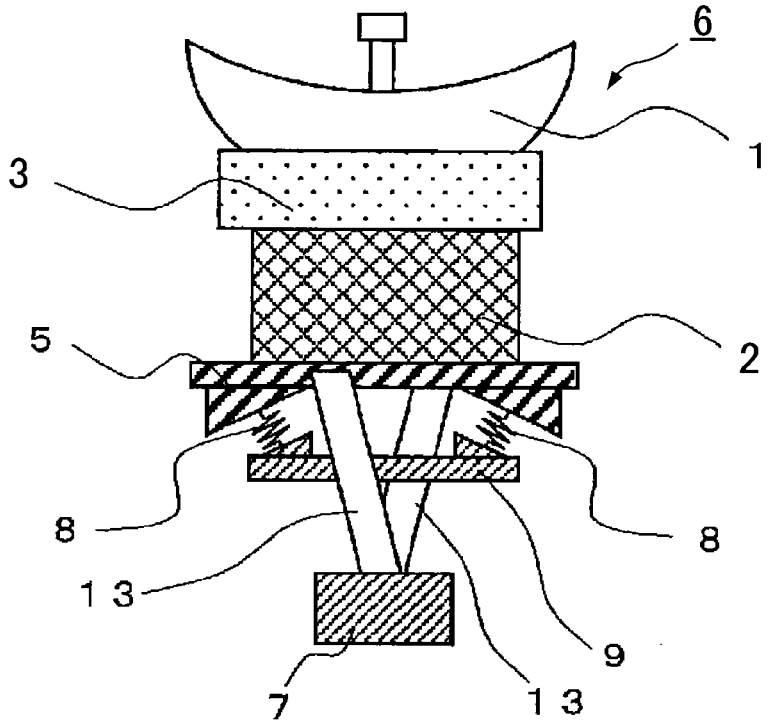
FIG. 4A is an exemplary diagram showing the antenna apparatus according to the embodiment.

FIG. 4A is an exemplary diagram showing the antenna apparatus according to this embodiment. With respect to the antenna apparatus shown in FIG. 4A, a structure (the vibration isolation structure) of the antenna apparatus shown in FIGS. 1 and 2 is exemplarily shown. Since it is an exemplary illustration, the vibration isolation structure 8 and the number of the beams 13 do not match those of the other figures.

According to the antenna apparatus exemplarily shown in FIG. 4A according to this embodiment has the counter weight unit 7 disposed at a side of the base 10 opposite to the antenna unit 6. The attaching height of the counter weight unit 7 can be set so as to be balanced with the centroid position of the antenna unit 6. Hence, the centroid of the antenna apparatus can be made closer to the base 10 in comparison with the structure shown in FIG. 3A. In viewing from the height direction with a surface of the first base plate 5 being as a horizontal plane, the centroid of the antenna apparatus can be easily set near the vibration isolation structure 8.

Figure 4B:
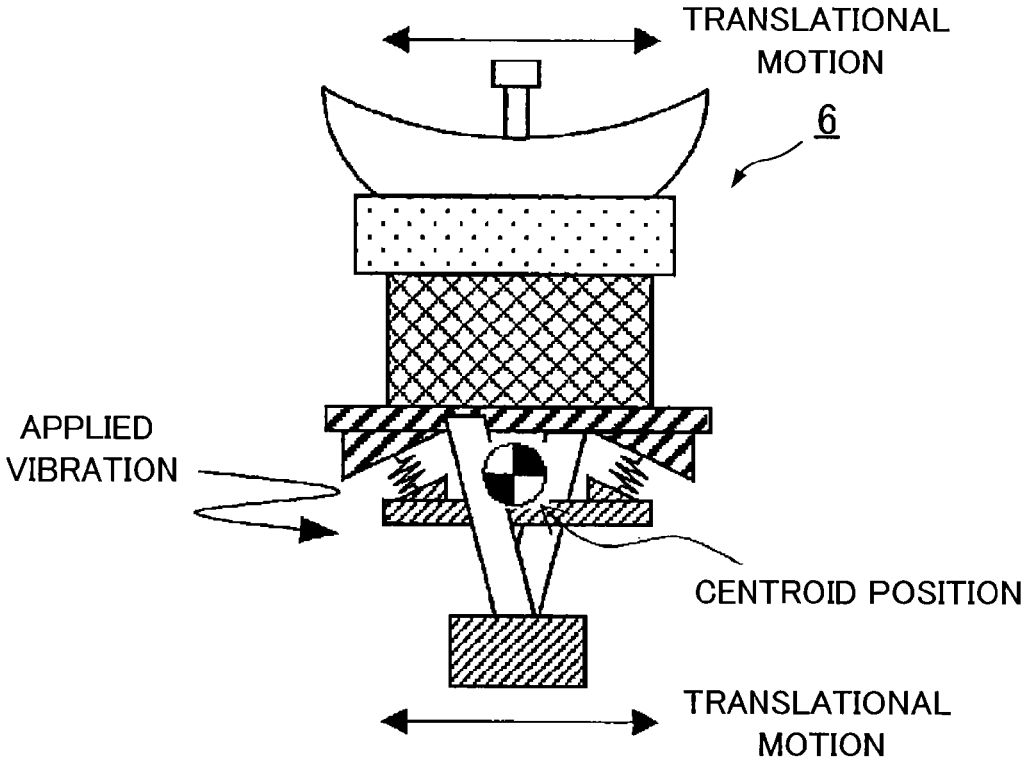
FIG. 4B is an explanatory diagram exemplarily showing a case in which vibration is applied to the base of the antenna apparatus shown in FIG. 4A.

When the centroid of the antenna apparatus is located closer to the vibration isolation structure 8, with respect to vibration in the horizontal direction of the antenna apparatus, the antenna unit 6 displaces only in the translational direction, or mainly in the translational direction (line segment arrow in FIG. 4B). As a result, the antenna unit 6 is hard to tilt. Hence, according to the antenna apparatus of this embodiment, when the base 10 moves, the main mirror reflector 1 does not vibrate like a pendulum motion, but takes a translational motion. As a result, the main mirror reflector 1 hardly tilts due to disturbance input, and the directivity error to the satellite, the earth station, and the mobile station, etc., is suppressed. Hence, the antenna apparatus according to this embodiment has good performance and reliability with respect to a tracking operation and a communication by the antenna apparatus.

Figure 5A:
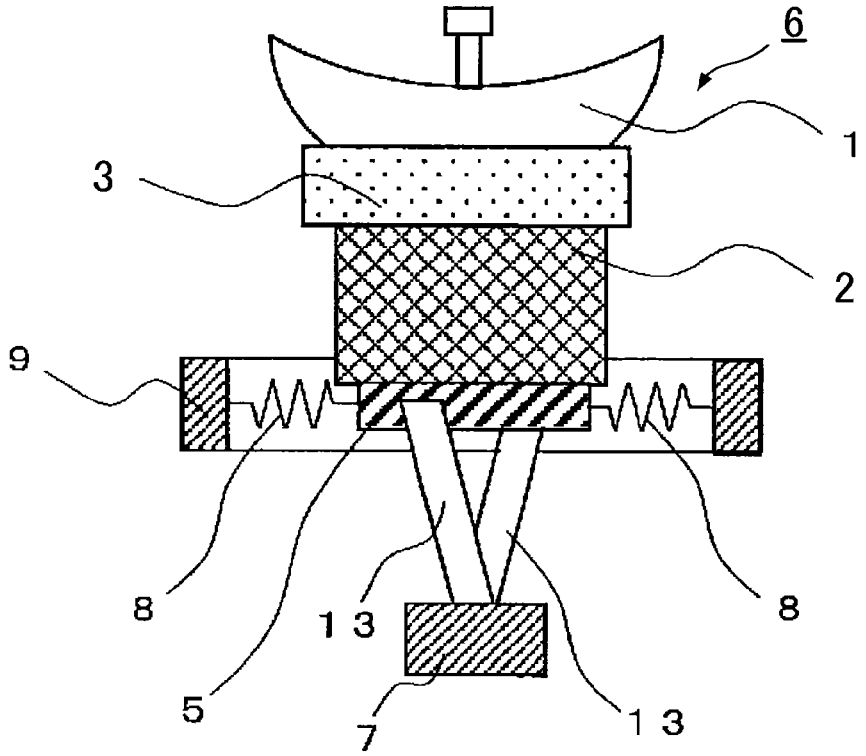
FIG. 5A is an exemplary diagram showing an antenna apparatus according to a modified example of the embodiment.

FIG. 5A is an exemplary diagram showing the antenna apparatus according to a modified example of this embodiment. The antenna apparatus shown in FIG. 5A has a different vibration isolation structural configuration from the vibration isolation structural configuration of the antenna apparatus shown in FIGS. 1 and 2.

The antenna apparatus shown in FIG. 5A has an opening which is formed in the center of the second base plate 9 and which can contain thereinside the first base plate 5. In FIG. 5A (FIG. 5B), the second base plate 9 is illustrated as a cross-sectional view. Since the second base plate 9 is annular, it can be regarded as a base ring. The first base plate 5 is held in the opening formed in the second base plate 9 using the vibration isolation structure 8. Since it is unnecessary to cause the first base plate 5 and the second base plate 9 to face with each other in the direction orthogonal to the principal surface, the antenna apparatus can have a lower height. In the case of the structure shown in FIG. 5A, the radome 11 can be fixed to the second base plate 9 (the base ring). A base support that supports the second base plate 9 to the moving object, etc., may be integral with the second base plate 9.

According to the antenna apparatus shown in FIG. 5A, also, the counter weight unit 7 is disposed at a side of the base 10 opposite to the antenna unit 6. Hence, like the antenna apparatus shown in FIG. 4A, the centroid is made closer to the vibration isolation structure 8. As a result, as shown in FIG. 5, the main mirror reflector 1 does not vibrate like a pendulum motion, but takes a translational motion. Accordingly, the main mirror reflector 1 hardly tilts due to disturbance input, and the directivity error to the satellite, the earth station, and the mobile station, etc., is extremely little. Accordingly, the antenna apparatus shown in FIG. 5A also has a good performance and reliability with respect to a tracking operation and a communication by this antenna apparatus.

The antenna apparatus shown in FIG. 4A has the first base plate 5 and the second base plate 9 facing with each other in a direction orthogonal to the principal surface, and thus this antenna apparatus employs a different structure for reducing the height. According to such a structure, in the first base plate 5 and the second base plate 9, respectively, portions of surfaces where the vibration isolation structure 8 is disposed are inclined, and portions other than the inclined surface portions are made thinner than the inclined surface portions, thereby allowing the second base plate 9 to be disposed near the bottom of the first base plate 5. The inclined surface portions and the other portions may have the same thickness to form cross section having both ends turned down (conical shape).

Figure 5B:
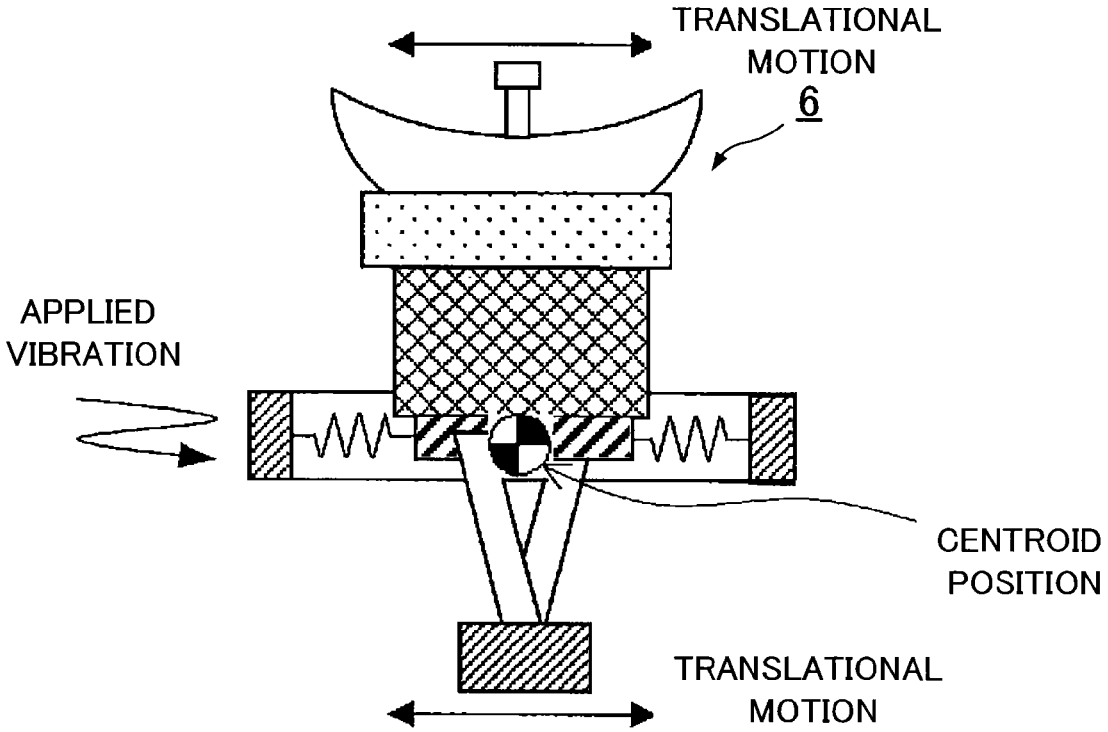
FIG. 5B is an explanatory diagram exemplarily showing a case in which vibration is applied to the base of the antenna apparatus shown in FIG. 5A.
Figure 6A:
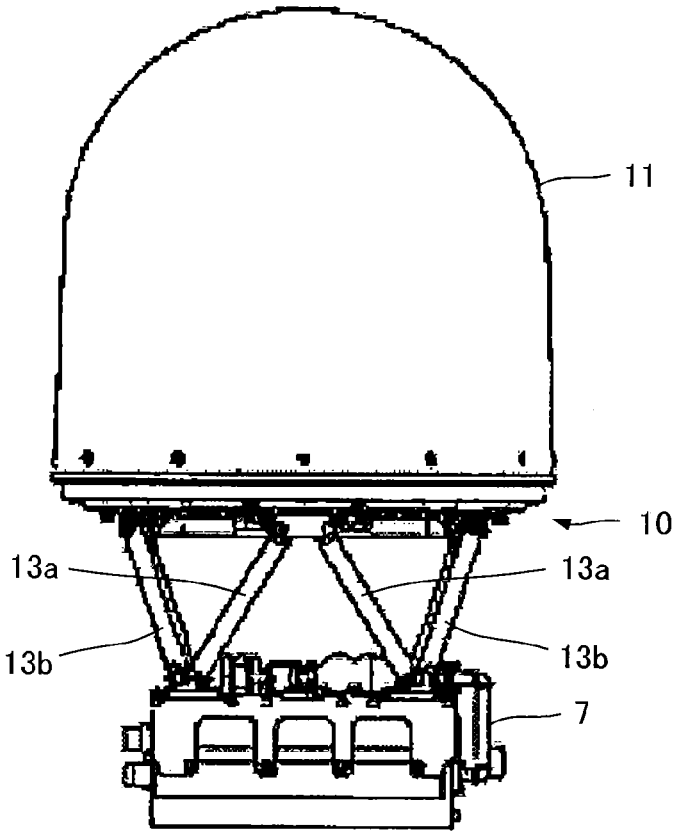
FIG. 6A is a front view showing the antenna apparatus provided with a radome according to the embodiment.
Figure 6B:
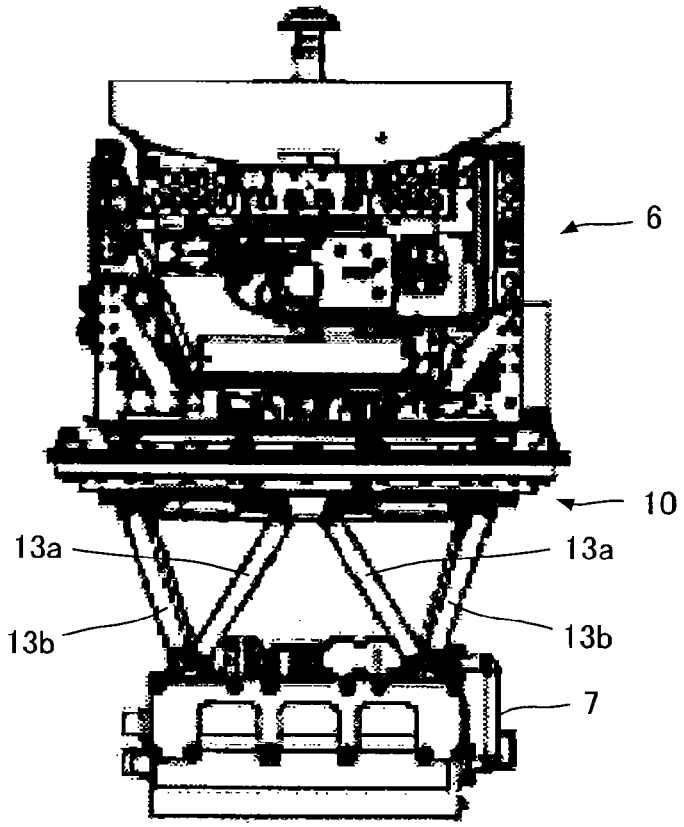
FIG. 6B is a front view showing the antenna apparatus according to the embodiment when the radome is detached.

Those structures facilitates formation of a fixing portion where the base support is fixed in comparison with the second base plate 9 (the base ring) shown in FIG. 5A. The method of making surfaces where the vibration isolation structure 8 is placed inclined in the first base plate 5 and the second base plate 9, respectively, can be also applied to the antenna apparatus shown in FIG. 5A (FIG. 5B). Moreover, the base support that supports the second base plate 9 can be integral with the second base plate 9.

As explained above, the antenna apparatus of this embodiment includes the counter weight unit 7 (the transmitting/receiving process unit) supported by the base 10 through the plurality of beams 13 at a side of the base 10 opposite to the antenna unit 6. The vibration isolation structure 8 having at least a portion disposed on the attaching surface at a position where the centroid of the configuration including the antenna unit 6 and the counter weight unit 7 (the transmitting/receiving process unit) is located suppresses a vibration of the antenna unit 6 and the counter weight unit 7 (the transmitting/receiving process unit). The vibration isolation structural configuration of this embodiment has one end fixed to the antenna unit 6 or the beam 13 through the base 10 (the first base plate 5). It can be said that the antenna apparatus has the second base plate 9 that is a vibration isolation structure fixing component of the vibration isolation structure where other end of the vibration isolation structure 8 is fixed.

When the opening of the radome 11 of the antenna apparatus according to this embodiment is in a circular shape, it is preferable that the external shape of the base 10 should be also in a circular shape. According to the antenna apparatuses shown in FIGS. 1 to 5B other than FIGS. 3A and 3B and antenna apparatuses shown in FIGS. 6A to 15C to be discussed later, the opening of the radome 11 is in a circular shape, and the external shape of the base 10 is also in a circular shape. When the radome 11 is fixed to the first base plate 5, in a case the first base plate 5 has a circular external shape, it is unnecessary that the second base plate 9 has a circular external shape. Conversely, when the radome 11 is fixed to the second base plate 9, in a case the second base plate 9 has a circular external shape, it is unnecessary that the first base plate 5 has a circular external shape.

Figure 11:
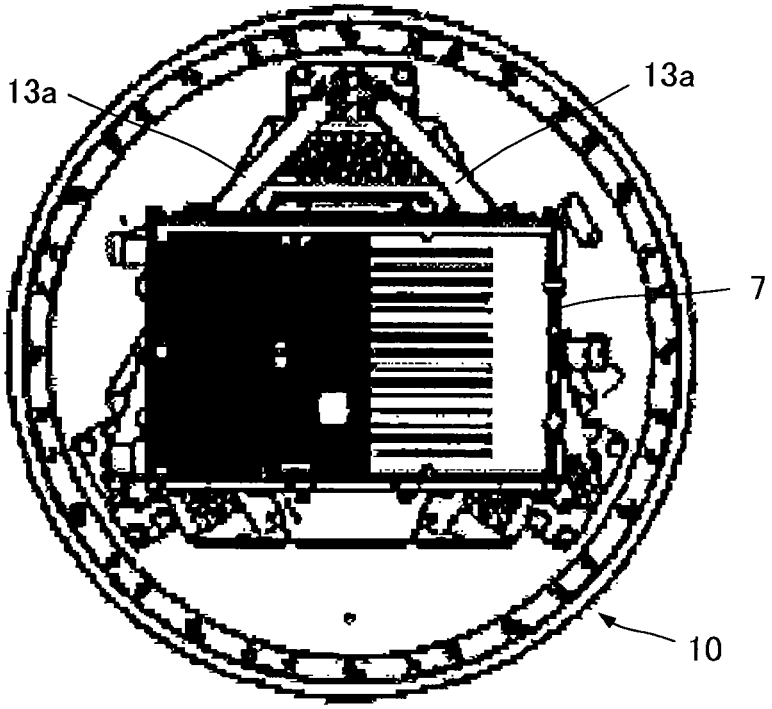
FIG. 11 is a bottom view showing the antenna apparatus according to the embodiment of the present invention.
Figure 12A:
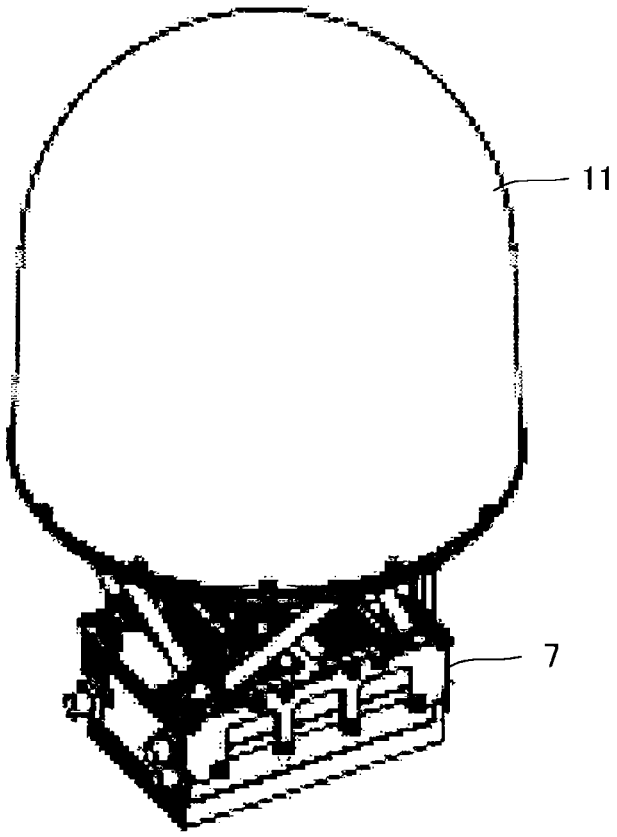
FIG. 12A is a perspective view showing the antenna apparatus provided with a radome according to the embodiment.
Figure 12B:
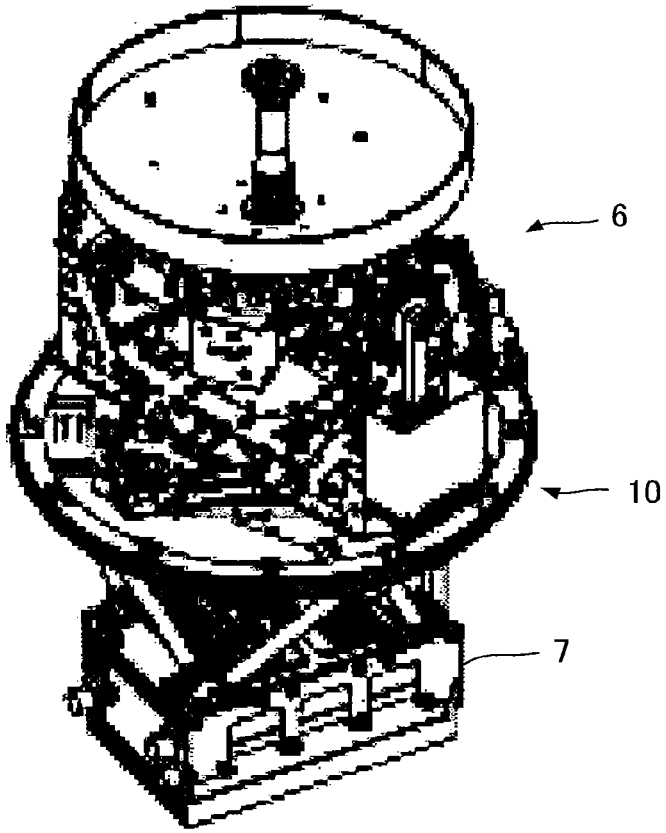
FIG. 12B is a perspective view showing the antenna apparatus according to the embodiment when the radome is detached.

FIGS. 6A to 12B show a shape of the antenna apparatus according to this embodiment, and are front views (FIGS. 6A and B), back views (FIGS. 7A and B), right side views (FIGS. 8A and B), left side views (FIGS. 9A and B), top views (FIGS. 10A and B), a bottom view (FIG. 11), and perspective views (FIGS. 12A and B), respectively. FIGS. 6A, 7A, 8A, 9A, 10A, and 12A show a condition with the radome 11 being attached. FIGS. 6B, 7B, 8B, 9B, 10B, and 12B show a condition without the radome 11. The radome 11 cannot be seen in the bottom view (FIG. 11). The antenna apparatus of this embodiment includes the antenna unit 6, the counter weight unit 7 (the transmitting/receiving unit), and the vibration isolation structure 8. The antenna apparatus is mainly used for a communication device for an antenna apparatus mounting object (a moving object or a structural object) that is an object on which an antenna apparatus is mounted.

The counter weight unit 7 is attached at a side of the base 10 opposite to the antenna unit 6 by a truss structure (the plurality of beams 13). The antenna apparatus is mounted on the antenna apparatus mounting object through the vibration isolation structure 8 formed on the base 10 and a base support 12 (see FIGS. 15A to 15C). As a result, the antenna apparatus has a function of reducing vibration transmitted from the antenna apparatus mounting object to the antenna apparatus. The antenna apparatus of this embodiment can be mounted on an antenna apparatus mounting object that moves at a fast speed or an antenna apparatus mounting object that keenly changes an altitude or an inclination.

When, for example, the antenna apparatus is mounted on a communication station on the ground, a vehicle moving on the ground, or a ship sailing the ocean, the antenna unit 6 is disposed upwardly of the base 10 in most cases. In this case, the counter weight unit 7 is disposed downwardly of the base 10. When, for example, the antenna apparatus is mounted on an aircraft and communicates with a communication device on the ground, the antenna unit 6 is disposed downwardly of the base 10. In this case, the counter weight unit 7 is disposed upwardly of the base 10. In any cases, the centroid of the antenna apparatus of this embodiment is located close to the base 10 fixed to the moving object or the structural object, and the main mirror reflector 1 does not vibrate like a pendulum motion but takes a translational motion. Hence, the main mirror reflector 1 hardly tilts due to disturbance input, and the pointing error to the satellite, the earth station, and the mobile station, etc., is suppressed.

Figure 13A:
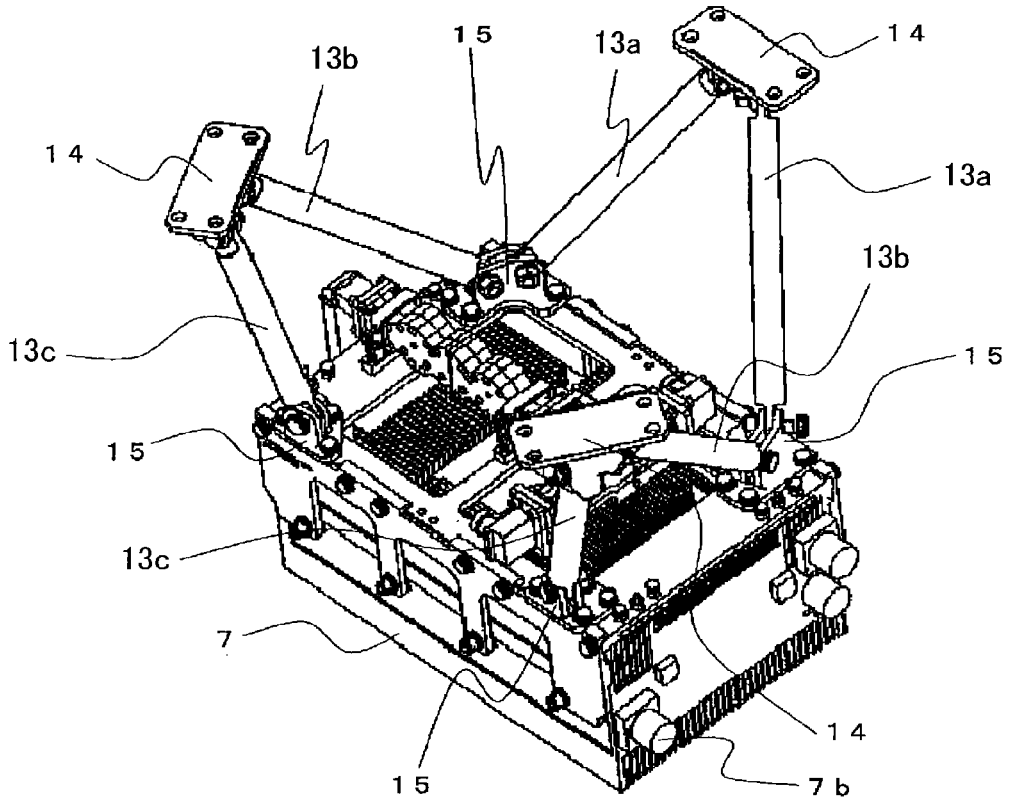
FIG. 13A is a perspective view showing a counter weight unit of the antenna apparatus as viewed from a base side according to the embodiment.
Figure 13B:
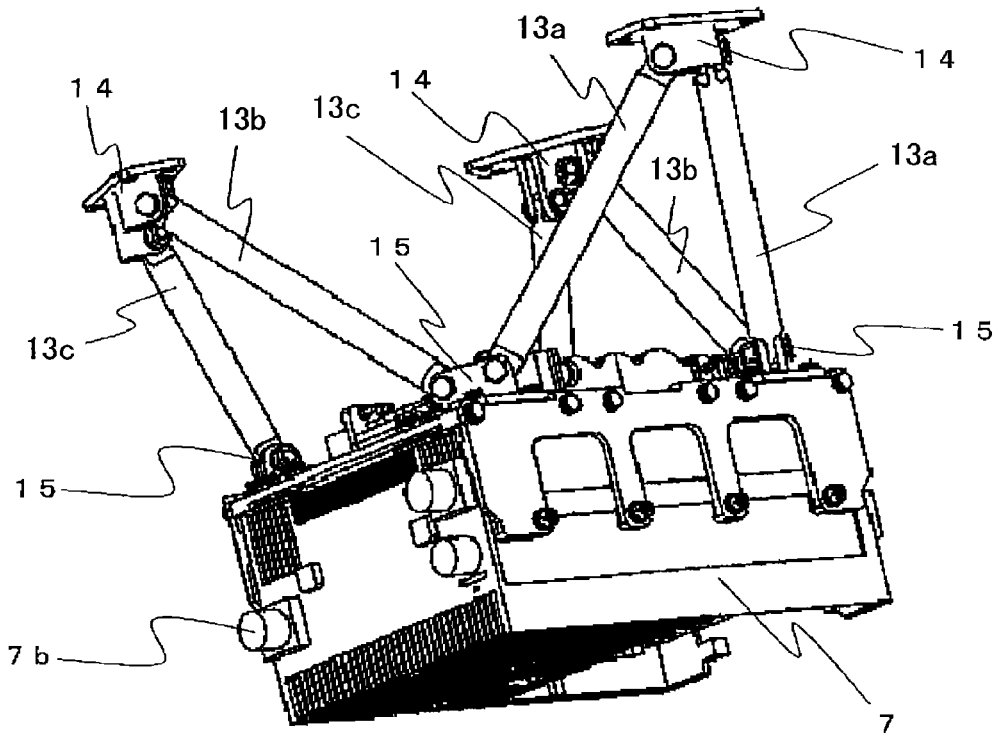
FIG. 13B is a perspective view showing the counter weight unit of the antenna apparatus as viewed from a side opposite to the base according to the embodiment.

FIG. 13A is a perspective view showing the counter weight unit of the antenna apparatus of this embodiment as viewed from a base side. FIG. 13B is a perspective view showing the counter weight unit of the antenna apparatus of this embodiment as viewed from an opposite side to the base. The antenna unit 6 (the radome 11) and the base 10 are omitted in FIGS. 13A and 13B. The three first beam fixing portions 14 are provided at respective vertices of a right triangle so as to be distributed over the circular base 10 (the first base plate 5) in a balanced manner. A total of four second beam fixing portions 15 are disposed at four corners of the surface of the substantially rectangular counter weight unit 7 (the transmitting/receiving process unit) at the base 10 side. The first beam fixing portion 14 and the second beam fixing portion 15 are fastened (fixed) to the first base plate 5 and the counter weight unit 7, respectively, by fastening means (fixing means).

As is clear from the back view (FIGS. 7A and 7B) of the shape of the antenna apparatus, there are only two beams 13*c* at the rearmost side. Each of the two second beam fixing portions 15 for joining the two beams 13*c* with the counter weight unit 7 joins each beam 13*c*, and thus no pin joint structure is employed. All beams 13 may configure a truss structure.

Figure 14:
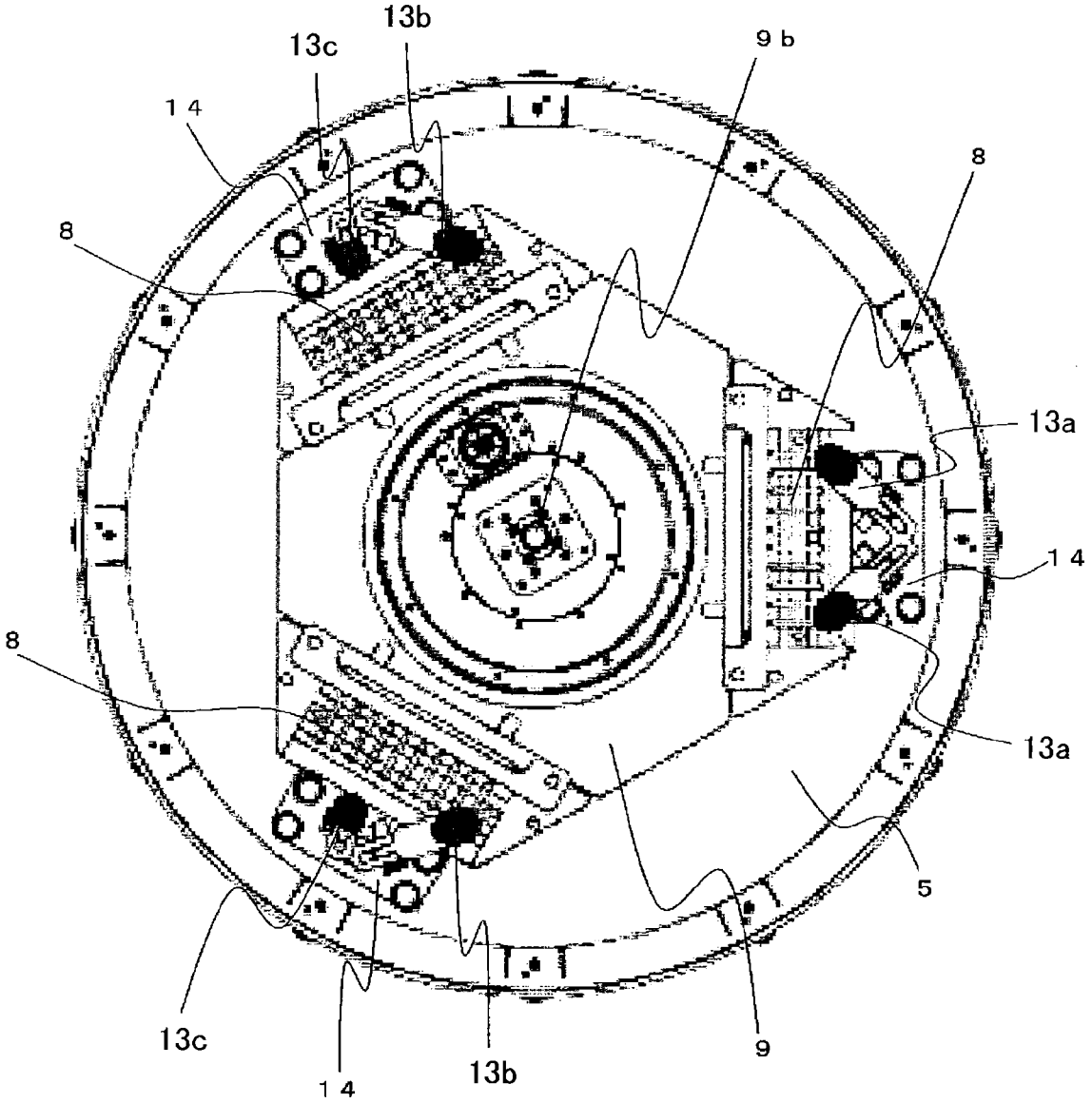
FIG. 14 is a plan view showing a base structure of the antenna apparatus according to the embodiment.

FIG. 14 is a plan view showing a base structure of the antenna apparatus according to this embodiment. FIG. 14 shows a cross section taken along a line C-C in FIG. 1. FIG. 14 is a bottom view of the antenna apparatus with the counter weight unit 7 being omitted. FIG. 14 also shows a cross-section of the beam 13 attached to the first beam fixing portion 14.

At the bottom of the base 10, the circular first base plate 5, and a hexagonal opening formed by cutting respective vertices of a triangle formed in the first base plate 5 can be seen. The second base plate 9 may have the same external shape as the shape of this opening. Moreover, a part of the helical isolator (the vibration isolation structure 8) disposed horizontally can be seen from a space between the first base plate 5 and the second base plate 9. A portion of the first base plate 5 where the first beam fixing portion 14 is fixed is referred to as a first beam fixing surface.

The helical isolators (the vibration isolation structure 8) are provided inwardly of the short sides of the hexagon formed by cutting respective vertices of the above-explained triangle. In other words, the helical isolators are disposed alternately at six sides forming the hexagon. In particular, in the case of FIG. 14, the helical isolators are disposed along the three short sides among the three long sides and the three short sides all forming the hexagon. The first beam fixing portion 14 is formed at the portion of the first base plate 5 facing with the location where the helical isolator is disposed on the plane that is the base 10. That is, the first beam fixing portion 14 is formed at an area of the first base plate located outwardly of the short side of the above-explained hexagon.

Figure 15A:
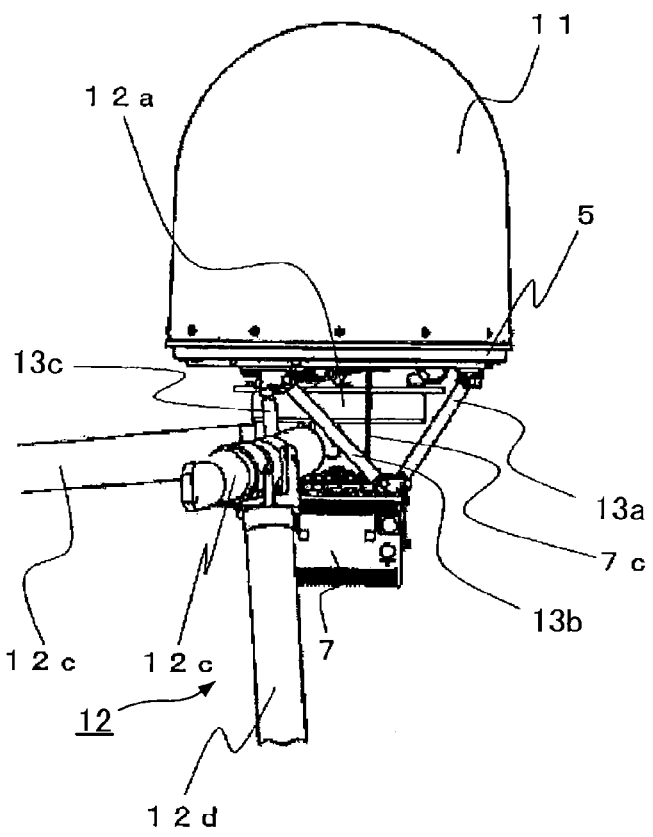
FIG. 15A is a left side view showing the antenna apparatus provided with a base support unit according to the embodiment.
Figure 15B:
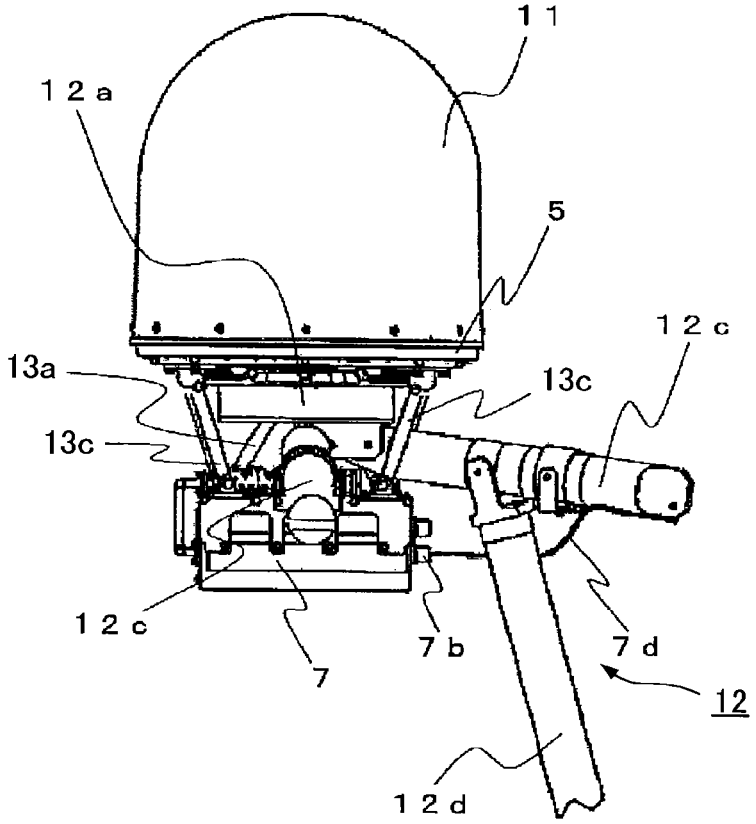
FIG. 15B is a back view showing the antenna apparatus provided with the base support unit according to the embodiment.
Figure 15C:
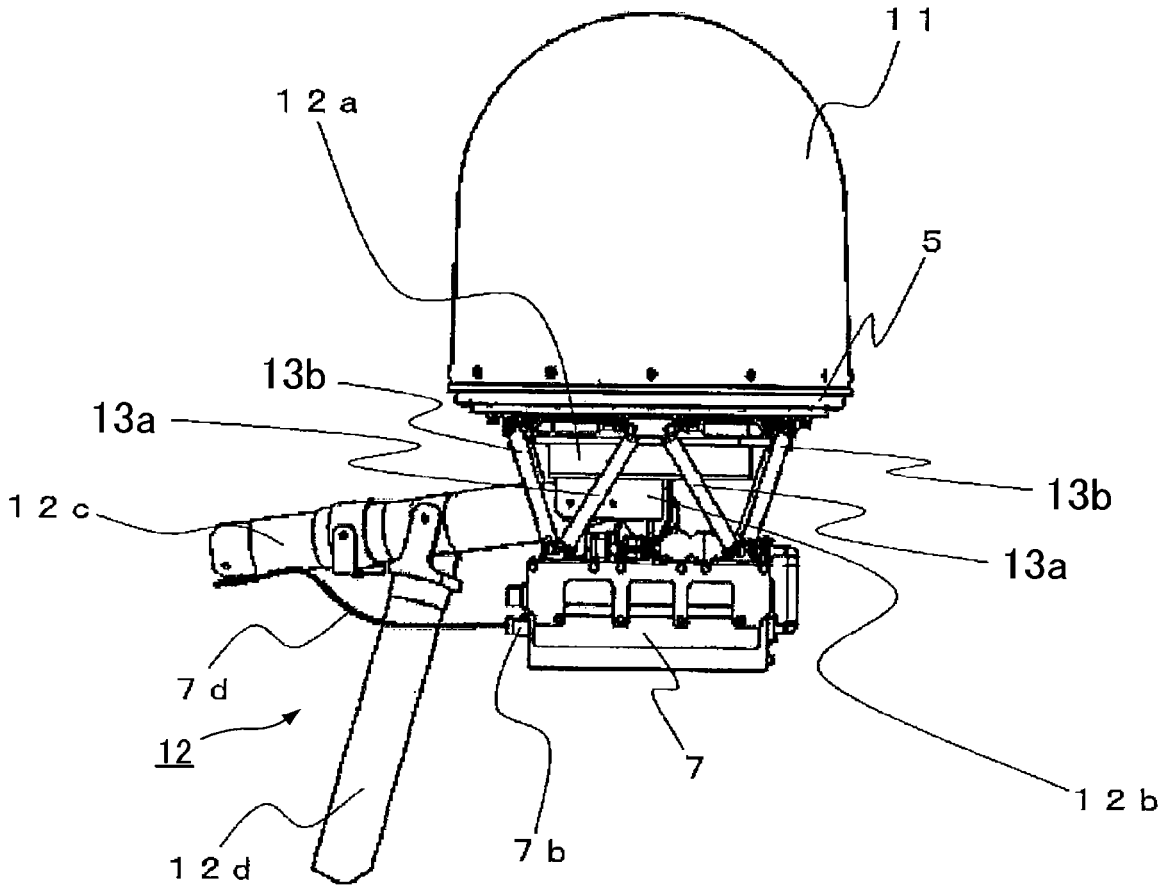
FIG. 15C is a front view showing the antenna apparatus provided with the base support unit according to the embodiment.

FIG. 15A is a left side view of the antenna apparatus provided with a base support according to this embodiment. FIG. 15B is a back view of the antenna apparatus provided with the base plate according to this embodiment. FIG. 15C is a front view of the antenna apparatus provided with the base support according to this embodiment.

The base support 12 is to support the antenna apparatus of this embodiment, has one end fixed to the second base plate 9, and has another end fixed to the moving object or a structural object (not illustrated in figures) on which the antenna apparatus is mounted. The base support 12 is disposed at a location between the counter weight unit 7 and the second base plate 9, and supports the second base plate 9. Since the base support 12 is fixed to the second base plate 9, it can be regarded as the second base plate support.

The base support 12 includes a stage 12*a*, two columns 12*c*, and supporting columns 12*d*. The stage 12*a* is fixed to the second base plate 9. The two columns 12*c* are fixed to the stage 12*a* through a hinge 12*b*. The supporting column 12*d* supports the middle part of the column 12*c*. The columns 12*c* and the supporting columns 12*d* are fixed to the unillustrated object on which the antenna apparatus is mounted. The antenna apparatus of this embodiment including the base support 12 may be collectively referred to as an antenna apparatus.

The base support 12 has one end (the stage 12*a*) coupled with an area 9*b* of the base plate 9 shown in FIG. 14. The area 9*b* is surrounded by the plurality of first beam fixing portions 14. In other case, the area 9*b* is surrounded by portions of the first base plate 5 where the plurality of beams 13 forming the truss structure are coupled with the first base plate 5. It is ideal that the area 9*b* is formed at an area including the center of the base 10 from the standpoint of vibration isolation.

As shown in FIGS. 13A and 13B, the space between the beams 13 which are located at the rearmost side is largely opened, it is easy to dispose the columnar base support 12 through the space. The stage 12*a* including the hinges 12*b* can be easily attached to the area 9*b*, which largely reduces the necessity of detachment of the beams 13 from the first base plate 5.

FIGS. 15A, 15B, and 15C show a case in which cables 7*c* (signal lines, control lines, etc.) for interconnecting the transmitting/receiving process unit 7 and the antenna unit 6 are not fixed to the beam 13. Moreover, those figures show a case in which a cable 7*d* for interconnecting a connector 7*b* of the transmitting/receiving process unit (the counter weight unit 7) and a communication device (unillustrated) mounted on the antenna apparatus mounting object is fixed to the column 12*c*.

When a communication is established using the antenna apparatus of this embodiment, at the time of data transmission, transmission signals from the communication device is transmitted to the transmitting/receiving process unit (the counter weight unit 7) through the cable 7*d*. Next, such signals are transmitted to the antenna unit 6 from the transmitting/receiving process unit through the cables 7*c*. A tracking antenna is built in the antenna unit 6, and the antenna unit 6 transmits the transmission signals to, for example, a satellite. At the time of data reception, receiving signals are transmitted through the inversed route.

Since the antenna apparatus of this embodiment includes the counter weight unit 7 which is supported by the first base plate 5 at a side of the first base plate 5 opposite to a side where the antenna unit 6 is disposed, the antenna apparatus of this embodiment has the centroid located close to the first base plate 5 and has a less constraint for placement of the counter weight 7. Furthermore, the centroid located close to the first base plate 5, which is located at an end of the vibration isolation structure 8, and the vibration isolation structure 8 joining the first base plate 5 and the second base plate 9 accomplish a good vibration isolation function.

The above-explained embodiment can be changed and modified in various forms within the scope and spirit of the present invention. The above-explained embodiment is to explain the present invention, and is not intended to limit the scope and spirit of the present invention. It should be understood that the scope and spirit of the present invention is indicated by the appended claims rather than the embodiment. Various changes and modifications within the limitations in the claims and the equivalent thereto are also included in the scope and spirit of the present invention.

This application claims the benefit of a priority based on Japanese Patent Application No. 2011-189314 filed on Aug. 31, 2011, including the specification, claims, drawings, and abstract. The disclosure of this Japanese Patent Application is herein incorporated in this specification by reference.

REFERENCE SIGNS LIST

1 Main mirror reflector
2 Antenna driving unit
2*b* Drive control unit
3 AZ/EL axis driving unit
4 POL axis driving unit
5 First base plate
6 Antenna unit
6*b* LNA
6*c* Antenna unit
7 Counter weight unit
7*b* Connector
7*c* Cable
7*d* Cable
8 Vibration isolation structure
8*b* Vibration isolation structure
9 Second base plate
9*b* Area
10 Base
10*b* Base
11 Radome
12 Base support
12*a* Stage
12*b* Hinge
12*c* Column
12*d* Support column
13, 13*a*, 13*b*, 13*c* Beam
14 First beam fixing portion
15 Second beam fixing portion

The invention claimed is:

1. An antenna apparatus comprising:
a first base plate;
an antenna unit which is disposed at a side of the first base plate and which is supported by the first base plate;
a counter weight unit which is disposed at another side of the first base plate opposite to the antenna unit, and which is supported by the first base plate;
a vibration isolation structure that has at least a portion disposed on a plane passing through a centroid of a structure configured by the antenna unit and the counter weight unit and being parallel to the first base plate and one end fixed to the first base plate to suppress a vibration of the first base plate; and
a second base plate to which another end of the vibration isolation structure is fixed, and which is fixed to a moving object or a structural object.

2. The antenna apparatus according to claim 1, wherein the second base plate is disposed between the first base plate and the counter weight unit.

3. The antenna apparatus according to claim 1, wherein the vibration isolation structure has a helical isolator disposed between the first base plate and the second base plate.

4. The antenna apparatus according to claim 1, wherein the second base plate is fixed to the moving object or the structural object through a base support disposed between the counter weight unit and the second base plate.

5. The antenna apparatus according to claim 4, wherein the base support has one end fixed to the second base plate, and has other end fixed to the moving object or the structural object.

6. The antenna apparatus according to claim 1, wherein the counter weight unit is supported by the first base plate through a plurality of beams.

7. An antenna apparatus comprising:
a first base plate;
an antenna unit which is disposed at a side of the first base plate and which is supported by the first base plate;
a counter weight unit which is disposed at another side of the first base plate opposite to the antenna unit, and which is supported by the first base plate;
a vibration isolation structure that has one end fixed to the first base plate to suppress a vibration of the first base plate; and
a second base plate to which another end of the vibration isolation structure is fixed, and which is fixed to a moving object or a structural object,
wherein
the counter weight unit is supported by the first base plate through a plurality of beams,
the first base plate has a first beam fixing portion to which respective one ends of the two beams are fixed at a distance which can be regarded as a pin joint, and
the counter weight unit has a second beam fixing portion to which respective other ends of the two beams are fixed at a distance which can be regarded as a pin joint.

8. The antenna apparatus according to claim 7, wherein for at least one first beam fixing portion, the two beams having respective one ends fixed to the first beam fixing portion have respective other ends fixed to the different second beam fixing portions.

9. An antenna apparatus comprising:

a first base plate;

an antenna unit which is disposed at a side of the first base plate and which is supported by the first base plate;

a counter weight unit which is disposed at another side of the first base plate opposite to the antenna unit, and which is supported by the first base plate;

a vibration isolation structure that has one end fixed to the first base plate to suppress a vibration of the first base plate; and a second base plate to which another end of the vibration isolation structure is fixed, and which is fixed to a moving object or a structural object, wherein the counter weight unit is supported by the first base plate through a plurality of beams, the first base plate is provided with a plurality of fixing portions to which respective ends of the plurality of beams are fixed, and one end of the base support that fixes the second base plate to the moving object or the structural object is fixed to an area of the second base plate surrounded by the plurality of fixing portions provided on the first base plate.

10. The antenna apparatus according to claim 1, wherein the counter weight unit is supported by the first base plate through a plurality of beams configuring a truss structure.

11. An antenna apparatus comprising:

a first base plate;

an antenna unit which is disposed at a side of the first base plate and which is supported by the first base plate;

a counter weight unit which is disposed at another side of the first base plate opposite to the antenna unit, and which is supported by the first base plate;

a vibration isolation structure that has one end fixed to the first base plate to suppress a vibration of the first base plate; and a second base plate to which another end of the vibration isolation structure is fixed, and which is fixed to a moving object or a structural object, wherein the counter weight unit is supported by the first base plate through a plurality of beams configuring a truss structure, one end of the base support that fixes the second base plate to the moving object or the structural object is fixed to an area of the second base plate surrounded by portions of the first base plate where the plurality of beams configuring the truss structure are coupled, respectively.

12. The antenna apparatus according to claim 1, wherein a transmitting/receiving process unit which executes a receiving process on a signal received by the antenna unit and/or which executes a transmitting process on a signal to be transmitted through the antenna unit is contained in the counter weight unit.

13. The antenna apparatus according to claim 1, further comprising a radome which is fixed to the first base plate and which covers the antenna unit.

* * * * *